US011712729B2

(12) United States Patent
Miyake et al.

(10) Patent No.: US 11,712,729 B2
(45) Date of Patent: Aug. 1, 2023

(54) PRODUCTION METHOD FOR PRESSED COMPONENTS, PRESS FORMING DEVICE, AND METAL SHEET FOR PRESS FORMING

(71) Applicant: JFE STEEL CORPORATION, Tokyo (JP)

(72) Inventors: Hiroto Miyake, Tokyo (JP); Toyohisa Shinmiya, Tokyo (JP); Yuji Yamasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/975,601

(22) PCT Filed: Feb. 21, 2019

(86) PCT No.: PCT/JP2019/006553
§ 371 (c)(1),
(2) Date: Aug. 25, 2020

(87) PCT Pub. No.: WO2019/167793
PCT Pub. Date: Sep. 6, 2019

(65) Prior Publication Data

US 2020/0398328 A1 Dec. 24, 2020

(30) Foreign Application Priority Data

Feb. 28, 2018 (JP) ..... JP2018-034571

(51) Int. Cl.
*B21D 22/26* (2006.01)

(52) U.S. Cl.
CPC ..... *B21D 22/26* (2013.01)

(58) Field of Classification Search
CPC ..... B21D 22/02; B21D 22/027; B21D 22/06; B21D 22/10; B21D 22/20; B21D 22/21; B21D 22/22; B21D 22/26
(Continued)

(56) References Cited

U.S. PATENT DOCUMENTS

2010/0201158 A1 8/2010 Miyashita
2015/0020563 A1 1/2015 Mildner et al.
(Continued)

FOREIGN PATENT DOCUMENTS

CA 3 018 484 A1 10/2017
CN 101801765 A 8/2010
(Continued)

OTHER PUBLICATIONS

Mar. 17, 2021 Extended Search Report issued in European Patent Application No. 19760805.2.
(Continued)

*Primary Examiner* — Shelley M Self
*Assistant Examiner* — Teresa A Guthrie
(74) *Attorney, Agent, or Firm* — Oliff PLC

(57) ABSTRACT

A press forming technology capable of reducing forming defects in a formed component having a hat-shaped cross-sectional shape and including a shape curved to protrude toward a flange portion in a side view. The technology includes a first forming step of press forming a metal sheet into an intermediate formed product that includes a wavy shape including uneven shapes continuous along a longitudinal direction in vertical wall portion and flange portion forming positions, an amplitude of the uneven shapes in a sheet thickness direction increasing toward a position corresponding to a boundary between the portions, and a second forming step of performing bending on the intermediate formed product. A longitudinal line length at the position corresponding to the boundary between the portions in the intermediate formed product is set to coincide with or approach a longitudinal line length at the boundary between the portions in the press-formed component shape.

18 Claims, 12 Drawing Sheets

(58) Field of Classification Search
USPC ..... 72/347
See application file for complete search history.

(56) References Cited

U.S. PATENT DOCUMENTS

| | | | |
|---|---|---|---|
| 2015/0336158 | A1 | 11/2015 | Miyagi et al. |
| 2017/0333972 | A1 | 11/2017 | Nishimura et al. |
| 2019/0030583 | A1 | 1/2019 | Nishimura et al. |

FOREIGN PATENT DOCUMENTS

| | | | | |
|---|---|---|---|---|
| CN | 202861089 | U | 4/2013 | |
| CN | 104290817 | A | 1/2015 | |
| JP | 2004-174531 | A | 6/2004 | |
| JP | 4021793 | B2 | 12/2007 | |
| JP | 2009-241109 | A | 10/2009 | |
| JP | 2009-255117 | A | 11/2009 | |
| WO | 2009/037537 | A1 | 3/2009 | |
| WO | 2016/075937 | A1 | 5/2016 | |
| WO | WO-2018012405 | A1 * | 1/2018 | ..... B21D 22/26 |
| WO | 2018/030240 | A1 | 2/2018 | |
| WO | WO-2018030240 | A1 * | 2/2018 | ..... B21D 22/20 |

OTHER PUBLICATIONS

Apr. 2, 2019 International Search Report issued in International Patent Application No. PCT/JP2019/006553.
Sep. 1, 2020 International Preliminary Report on Patentability issued in International Patent Application No. PCT/JP2019/006553.
Sep. 27, 2021 Office Action issued in Chinese Patent Application No. 201980015815.8.

* cited by examiner

RELATED ART

RELATED ART

PRODUCTION METHOD FOR PRESSED COMPONENTS, PRESS FORMING DEVICE, AND METAL SHEET FOR PRESS FORMING

TECHNICAL FIELD

The present invention is a technology relating to production of a press-formed component that has a hat-shaped cross-sectional shape including one or more curved portions protruding toward a flange portion (be recessed toward a top sheet portion) along a longitudinal direction as seen in a side view. In particular, the present invention is a technology suitable for production of a vehicle frame component including a portion curved toward a top sheet portion in a side view.

BACKGROUND ART

The vehicle frame component includes, for example, a top sheet portion and a vertical wall portion and a flange portion respectively continuous in a left-right widthwise direction of the top sheet portion, and is shaped to include a curved portion curved in a longitudinal direction as seen in the side view. When producing such a vehicle frame component from a flat metal sheet by press forming, a crack or a wrinkle may be formed on a part of the component, which can cause a forming defect. Moreover, problems may occur such as lowered dimensional accuracy due to elastic recovery in formed product after release.

Particularly, in recent vehicle frame components, use of a thin high strength steel sheet has been increasing in order to achieve both vehicle lightweighting and collision safety. However, with increased material strength (tensile strength) of the metal sheet, ductility of the metal sheet decreases, so that a large spring-back occurs in a press-formed product. Due to this, when a high strength steel sheet is simply press formed, problems such as cracks, wrinkles, and spring-back have become apparent.

For example, in a component shape including a top sheet portion and vertical wall portions and flange portions continuous thereto and including, at least one place, a curved portion shape curved in such a manner as to protrude toward the flange portion (be recessed toward the top sheet portion) as seen in a side view, material excess on the top sheet portion side causes a wrinkle, whereas material shortage on the flange portion sides causes cracks. Furthermore, due to an opening of cross section caused by spring-back and a stress difference in a longitudinal direction occurring between the top sheet portion and the flange portions, a poor dimensional accuracy tends to occur such that end portions in the longitudinal direction of the component fall in a direction where a curve of the curved portion shape seen in the side view becomes loose (a curvature of the curve becomes small). To cope with these forming defects, some countermeasure technologies have conventionally been proposed.

PTL 1 describes a technology, which is an example of countermeasures against a spring-back after release in a press-formed component shape including a curved portion so as to protrude toward a flange (be recessed toward a top sheet portion) in a longitudinal direction as seen in a side view. PTL 1 proposes a method for increasing rigidity of the entire component by providing a step on vertical wall portions in such a manner that the cross section widens toward the flanges over the entire longitudinal direction.

CITATION LIST

Patent Literature

PTL 1: JP Pat. No. 4021793

SUMMARY OF INVENTION

Technical Problem

However, in PTL 1, since it is necessary to provide a stepped shape on the vertical wall portions, the cross section of the desired press-formed component shape may change significantly, so that there is a limit to a range of application to press forming.

The present invention has been made in view of the above problem, and it is an object of the present invention to provide a press forming technology capable of reducing forming defects such as cracks, wrinkles, and lowered dimensional accuracy in a formed component that has a hat-shaped cross-sectional shape including, at least one place, a shape curved in such a manner as to protrude toward a flange portion as seen in a side view.

Solution to Problem

The present inventors conducted intensive studies about a press forming method capable of forming, without any cracks and wrinkles, a press-formed component shape that includes a top sheet portion and vertical wall portions and flange portions continuous to the top sheet portion and that includes, at least one place, a shape curved in such a manner as to protrude toward the flange portion (be recessed toward the top sheet portion) as seen in a side view, and also capable of suppressing spring-back. As a result of the studies, the present inventors found that material excess on the top sheet portion and material shortage on the flange portions, which are stresses that become factors causing cracks, wrinkles, and spring-back, can be reduced by previously performing stretch forming at a predetermined place in a pre-step before a step of forming into the press-formed component shape to secure a line length likely to be short of material.

The present invention has been made on the basis of such a finding.

To solve the problem, one aspect of the present invention is a method for producing a press-formed component for producing, by press forming a metal sheet, a press-formed component having a press-formed component shape that has a hat-shaped cross-sectional shape including a vertical wall portion and a flange portion on both sides of a widthwise direction of a top sheet portion and that includes, at one or more places along a longitudinal direction of the top sheet portion, a curved portion curved in such a manner as to protrude toward the flange portion as seen in a side view, the method including: a first forming step of press forming the metal sheet into an intermediate formed product in which a wavy shape is formed in regions to be the vertical wall portion and the flange portion; and a second forming step of performing bending on the intermediate formed product to form a ridge line between the top sheet portion and the vertical wall portion and a ridge line between the vertical wall portion and the flange portion in the press-formed component shape, in which the wavy shape includes uneven shapes arranged along a longitudinal direction, and is shaped such that an amplitude of the uneven shapes in a sheet thickness direction increases from a position corresponding to a boundary between the top sheet portion and the vertical wall portion toward a position corresponding to a boundary between the vertical wall portion and the flange portion; and in which the wavy shape is set such that a line length difference between a longitudinal line length at the position corresponding to the boundary between the vertical wall portion and the flange portion in the intermediate formed product and a longitudinal line length at the boundary between the vertical wall portion and the flange portion in the press-formed component shape is equal to or less than 10% of the longitudinal line length at the boundary between the vertical wall portion and the flange portion in the press-formed component shape.

Additionally, one aspect of the present invention is a press forming device for use in the second forming step of the method for producing a press-formed component according to the above aspect, the press forming device including an upper die including bending blades for bending the metal sheet at ridge line portion positions to perform bending of the vertical wall portion and the flange portion and a lower die including a punch, in which the bending blades are configured to move at an angle set within a range of from 0 degrees to 90 degrees with respect to a pressing direction to perform the bending.

In addition, one aspect of the present invention is a metal sheet for press forming to be formed into a press-formed component shape that has a hat-shaped cross-sectional shape including a vertical wall portion and a flange portion on both sides of a widthwise direction of a top sheet portion and that includes, at one or more places along a longitudinal direction of the top sheet portion, a curved portion curved in such a manner as to protrude toward the flange portion as seen in a side view, the metal sheet including a wavy shape that includes uneven shapes continuous along a longitudinal direction in regions to be the vertical wall portion and the flange portion, an amplitude of the uneven shapes in a sheet thickness direction increasing from a position corresponding to a boundary between the top sheet portion and the vertical wall portion toward a position corresponding to a boundary between the vertical wall portion and the flange portion, in which the wavy shape is set such that a line length difference between a longitudinal line length at the position corresponding to the boundary between the vertical wall portion and the flange portion and a longitudinal line length at the boundary between the vertical wall portion and the flange portion in the press-formed component shape is equal to or less than 10% of the longitudinal line length at the boundary between the vertical wall portion and the flange portion in the press-formed component shape.

Advantageous Effects of Invention

According to the aspects of the present invention, a formed component having a hat-shaped cross-sectional shape including, at least one place, a shape curved in such a manner as to protrude toward a flange portion as seen in a side view can be produced with reduced forming defects such as cracks, wrinkles, and lowered dimensional accuracy. Then, according to the aspects of the present invention, for example, a spring-back due to a stress difference in the longitudinal direction between the top sheet portion and the flange portions can be suppressed.

BRIEF DESCRIPTION OF DRAWINGS

FIG. 1 is a diagram illustrating a press-formed component shape according to an embodiment based on the present invention and shape parameters, in which

FIG. 7 is a diagram illustrating an example of an intermediate formed product, in which

DESCRIPTION OF EMBODIMENTS

Next, embodiments of the present invention will be described with reference to the drawings.

Figure 1A:
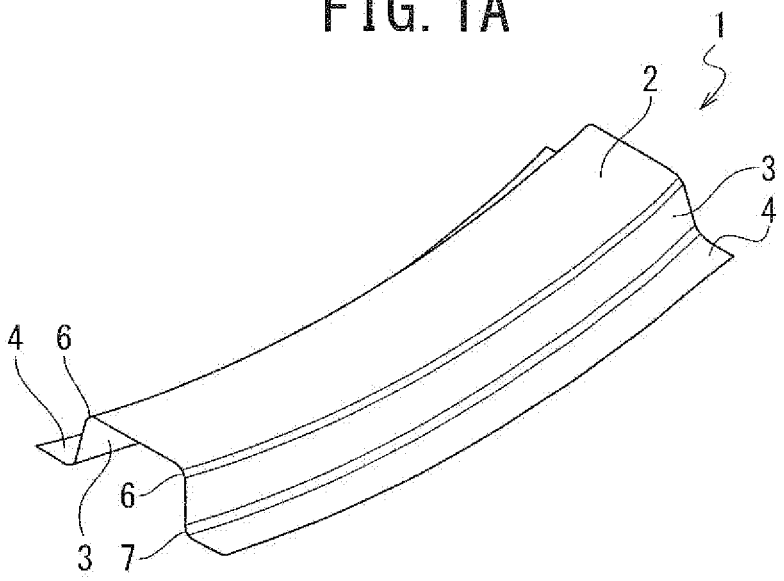
FIG. 1A is a perspective view.
Figure 1B:
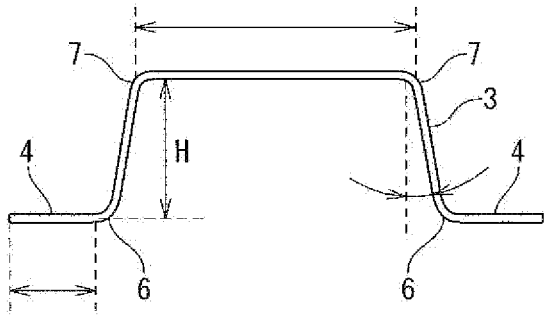
FIG. 1B is a cross-sectional shape.

Herein, as illustrated in FIG. 1, the following description will be given by exemplifying a case where a metal sheet is press formed into a press-formed component shape 1 that has a hat-shaped cross-sectional shape including a top sheet portion 2 and a vertical wall portion 3 and a flange portion 4 respectively continuous on both sides of a left-right widthwise direction of the top sheet portion 2 and that is curved in such a manner as to protrude toward the flange portion (be recessed toward the top sheet portion) along a longitudinal direction as seen in a side view.

The present invention is not limited to only the shape entirely curved in the longitudinal direction in such a manner as to protrude toward the flange portion as seen in the side view, as illustrated in FIG. 1. The present invention is also applicable to composite press-formed component shapes including a curved shape protruding toward the top sheet portion and a curved shape recessed toward the top sheet portion and press-formed component shapes including, at two or more places, a curved portion shape protruding toward the flange portions. Additionally, the present invention is also applicable to press-formed component shapes including a linear portion that is continuous to a curved portion curved in such a manner as to protrude toward the flange portion (be recessed toward the top sheet portion) along a longitudinal direction and that extends linearly along the longitudinal direction. Note that the linear portion itself is a portion whose longitudinal line length does not change or hardly changes when bending is performed. FIG. 2 illustrates examples of the press-formed component shape 1 to which the present invention can be applied.

<Metal Sheet 10>

The shape of a metal sheet 10 for use in press forming of the present embodiment is not particularly limited. A metal sheet shape that may be employed is, for example, a developed shape of the desired press-formed component shape 1 developed on a plane or a simple rectangular sheet shape. The present description will be given of an example of use of a rectangular metal sheet 10.

Additionally, the material of the metal sheet 10 is also not particularly limited. However, the present embodiment is suitably effective on a metal sheet made of a high strength material, particularly, a steel material having a material tensile strength of 590 MPa or more.

<Forming Method>

Figure 3:
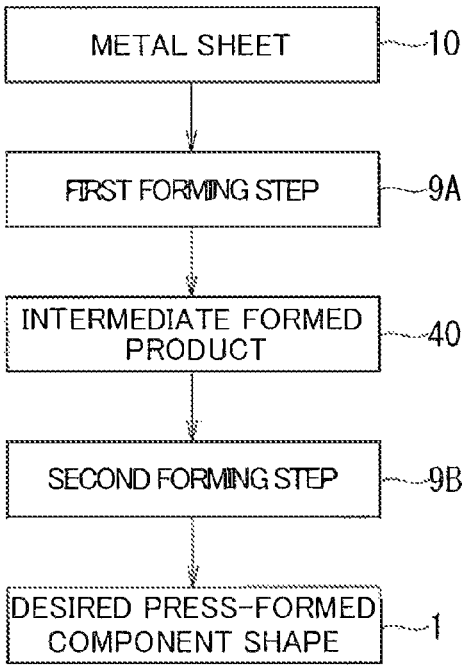
FIG. 3 is a diagram illustrating an example of forming steps according to an embodiment based on the present invention.

A method for producing a press-formed component according to the present embodiment includes at least a first forming step 9A and a second forming step 9B, as illustrated in FIG. 3. Since the present embodiment uses the rectangular sheet material as the metal sheet 10, a trimming step is included after the second forming step 9B. When using a sheet material having the developed shape as the metal sheet 10, the trimming step is not necessarily required.

Figure 4:
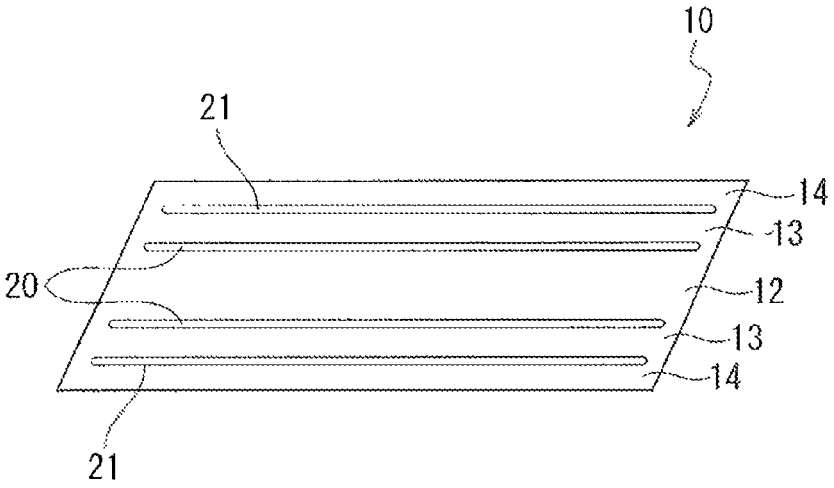
FIG. 4 is a diagram illustrating another example of a metal sheet.

Additionally, for a purpose of improving accuracy of the bending in the second forming step 9B, the method may include a ridge line pre-processing step as processing before the second forming step 9B. The ridge line pre-processing step is a step of forming, at least one position of a position 16 corresponding to a ridge line 6 between the top sheet portion 2 and the vertical wall portion 3 and a position 17 corresponding to a ridge line 7 between the vertical wall portion 3 and the flange portion 4, at least one bead shape 20, 21 or crease shape extending in a direction along the corresponding ridge line on the metal sheet 10, as illustrated in FIG. 4. The ridge line pre-processing step may be performed in the first forming step 9A or may be provided as a separate step before or after the first forming step 9A.

Although FIG. 4 exemplifies the case where the bead shape 20, 21 is provided, a crease shape may be provided instead of the bead shape 20, 21. Additionally, the bead shape 20, 21 and a crease shape may be used in combination in such a manner that the bead shape 20, 21 is provided at a part, and the crease shape is provided at the other part. In addition, the bead shape 20, 21 or a crease shape may be formed on only some of the ridge lines located at the ridge line positions. Furthermore, the bead shape or crease shape does not have to be formed over the entire length of one ridge line, and may be formed intermittently along the ridge line. When forming the bead shape 20, 21 at a part of the entire length of the ridge line, it is preferable to, for example, set so that a total length of the bead shape 20, 21 is equal to or more than ⅓ of the entire length of the corresponding ridge line.

Furthermore, when it is desired to further improve dimensional accuracy or when it is desired to provide a necessary shape (such as an embossed shape) to the component, a forming step for, for example, restrike may be added as a step subsequent to the second forming step 9B.

<First Forming Step 9A>

In the first forming step 9A, stretch forming is performed on the rectangular metal sheet 10 to produce an intermediate formed product 40.

The intermediate formed product 40 is a component in which the metal sheet 10 is formed with a wavy shape including uneven shapes continuous along a longitudinal direction in regions to be the vertical wall portion 3 and the flange portion 4 (a vertical wall portion forming position 13 and a flange portion forming position 14), an amplitude of the uneven shapes in a sheet thickness direction increasing from a position corresponding to a boundary between the top sheet portion 2 and the vertical wall portion 3 toward a position corresponding to a boundary 7 between the vertical wall portion 3 and the flange portion 4.

(Wavy Shape)

The wavy shape is set (designed) such that a line length difference between a longitudinal line length at the position 17 corresponding to the boundary 7 between the vertical wall portion 3 and the flange portion 4 and a longitudinal line length at the boundary (the ridge line 7) between the vertical wall portion 3 and the flange portion 4 in the press-formed component shape 1 is equal to or less than 10% of the longitudinal line length at the boundary between the vertical wall portion 3 and the flange portion 4 in the press-formed component shape 1. For example, in the wavy shape, a magnitude of the amplitude or the number of waves formed by unevenness is adjusted to secure an increase in the line length.

Although the present embodiment exemplifies a case where the wavy shape is formed on entire surfaces of the regions of the vertical wall portion forming position 13 and the flange portion forming position 14, the wavy shape may be formed on only a partial region in the longitudinal direction. However, as a longitudinal length of the region that is formed with the wavy shape is shorter, it is necessary to make the amplitude higher and make a wave pitch shorter. Thus, the wavy shape is preferably provided within a range of equal to or more than ⅔ of a longitudinal length of the metal sheet 10. Additionally, it is unnecessary to equalize amplitude heights of respective uneven portions and intervals of the waves. However, equalizing the amplitude heights of the respective uneven portions and the intervals of the waves facilitates formation of a die for the wavy shape, and the like.

Herein, the present embodiment exemplifies a case where a sheet that is used as the metal sheet 10 to be formed in the first forming step 9A is the metal sheet 10 that has the same longitudinal length as a longitudinal length of the top sheet portion 2 in the desired press-formed component shape 1. However, the production method of the present embodiment is applicable even when the longitudinal length of the metal sheet 10 is different from the longitudinal length of the top sheet portion 2 in the desired press-formed component shape 1.

Figure 1C:
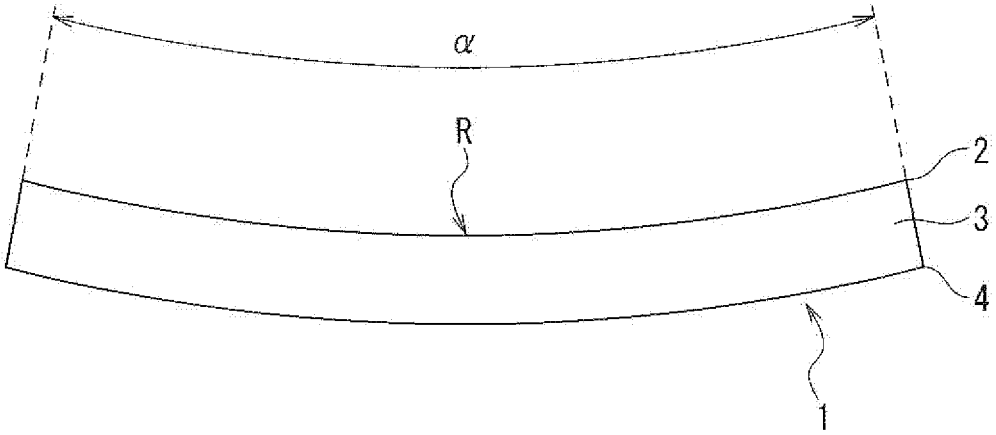
FIG. 1C is a side view.
Figure 2A:
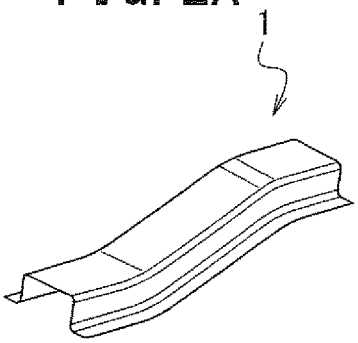
FIG. 2 is a diagram illustrating examples of press-formed component shapes to which the present invention can be applied.
Figure 2B:
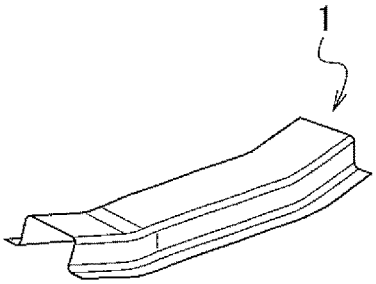
Figure 2C:
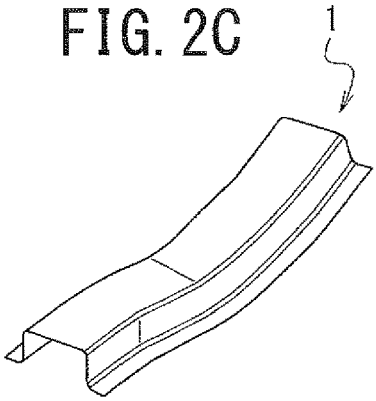
Figure 2D:
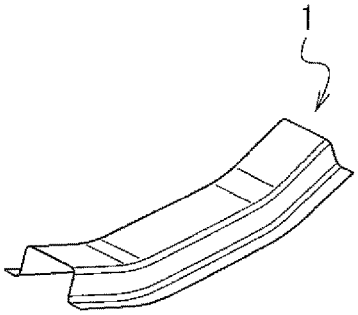
Figure 2E:
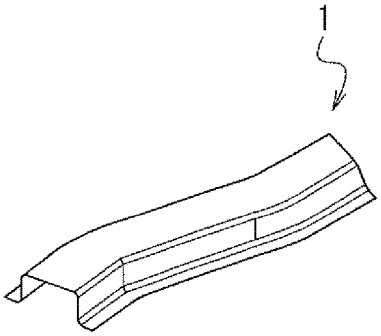
Figure 2F:
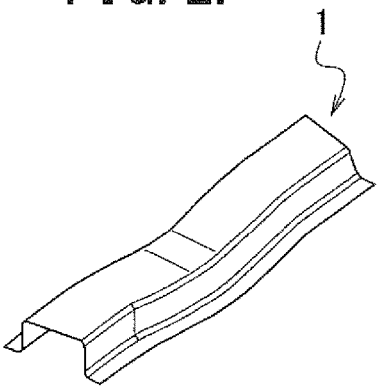
Figure 2G:
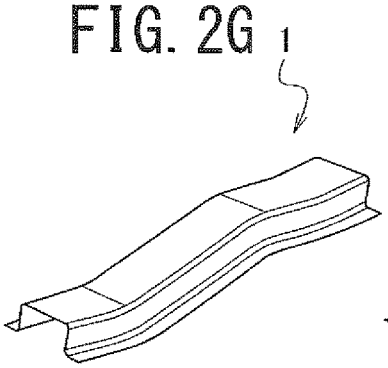
Figure 2H:
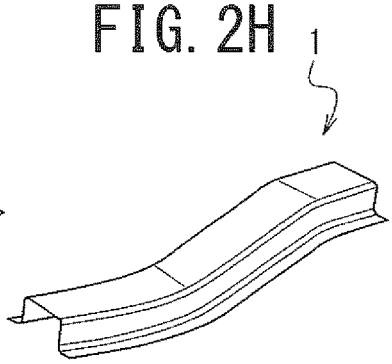
Figure 2I:
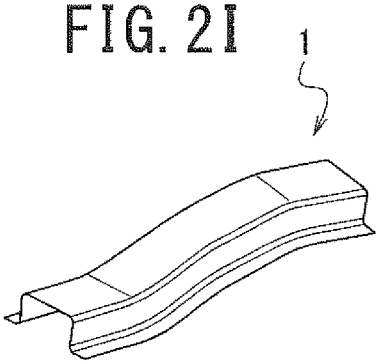
Figure 2J:
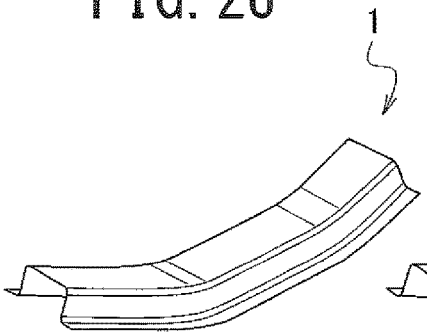
Figure 2K:
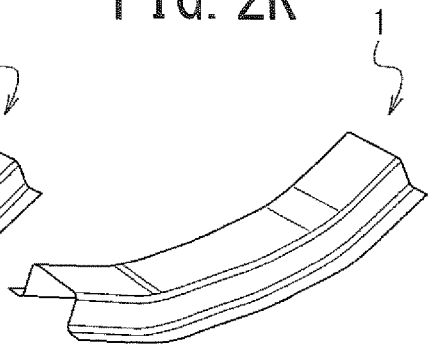

When attempting to form the metal sheet 10 into the desired press-formed component shape 1, a difference occurs between a longitudinal line length of the top sheet portion 2 and a longitudinal line length of the flange portion 4 in the desired press-formed component shape 1, as illustrated in FIG. 1C. A longitudinal line length L1 of the top sheet portion 2 in the press-formed component shape 1 is calculated by the following expression (1). Herein, a height of the vertical wall portion 3 in the press-formed component shape 1 is defined as H (mm), a longitudinal curvature radius of the top sheet portion 2 is defined as R (mm), and a longitudinal bending angle of the curved portion as seen in a side view is defined as α (degree).

$$L1=2\pi R\times(\alpha/360)\square \quad (1)$$

Similarly, a longitudinal line length L2 of the flange portion 4 in the press-formed component shape 1 is calculated by the following expression (2):

$$L2=2\pi(R+H)\times(\alpha/360)\square \quad (2)$$

Therefore, in the desired press-formed component shape 1, a line length difference ΔL that occurs between the top sheet portion 2 and the flange portion 4 is expressed by the following expression:

$$\Delta L=L2-L1=2\pi H\times(\alpha/360)\square \quad (3)$$

Based on this, the present embodiment designs (sets) the shape (wavy shape) of the intermediate formed product 40 in the first forming step 9A, which is required to secure the line length ΔL on the flange portion 4 side.

The method for forming the wavy shape is not limited to the following design method. The wavy shape may be designed by any other method than can design the wavy shape in such a manner that the line length difference between the longitudinal line length at the position 17 corresponding to the boundary 7 between the vertical wall portion 3 and the flange portion 4 in the intermediate formed product 40 and the longitudinal line length at the boundary 7 between the vertical wall portion 3 and the flange portion 4 in the press-formed component shape 1 is equal to or less than 10% of the longitudinal line length at the boundary 7 between the vertical wall portion 3 and the flange portion 4 in the press-formed component shape 1. Note that a waveform formed by the uneven shapes preferably has a contour shape that does not include a portion with steep curvature, where curvature changes steeply. Additionally, the contour shape does not have to be formed by only a curve, and may partially include a linear portion.

Figure 5A:
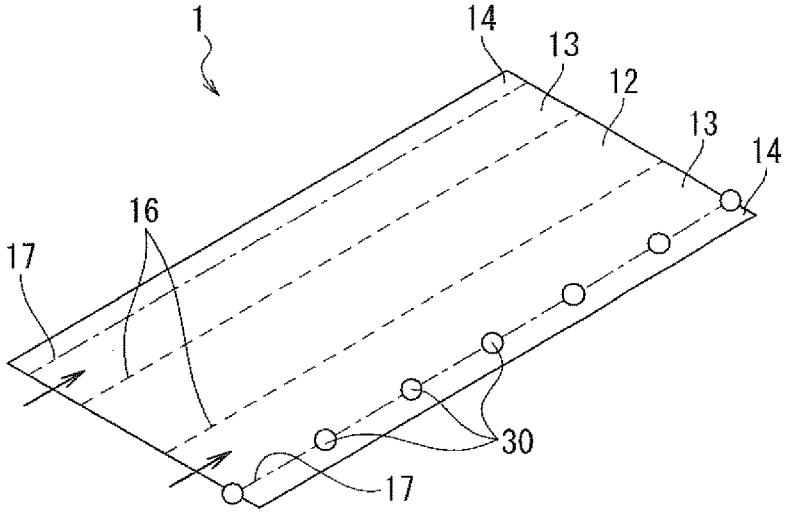
FIG. 5 is a diagram illustrating an example of setting of a control point.
Figure 5B:
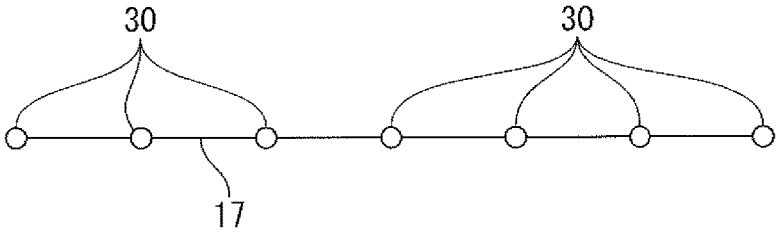

First, a surface of the rectangular metal sheet 10 to be press formed is virtually divided into regions of a top sheet portion forming position 12, the vertical wall portion forming position 13, and the flange portion forming position 14, as illustrated in FIG. 5.

In this case, the present embodiment sets the longitudinal length of the metal sheet 10 to a length equal to the length of the top sheet portion 2 in the desired press-formed component shape 1. Thus, there is no material excess nor shortage on the top sheet portion forming position 12, so that it is unnecessary to provide a projection shape for securing the line length.

On the other hand, in the vertical wall portion 3, the line length along the longitudinal direction gradually increases from the boundary 6 with the top sheet portion 2 toward the boundary 7 with the flange portion 4 by forming the flat-sheet shaped metal sheet 10 into the desired press-formed component shape 1.

In consideration of this, the present embodiment has been considered to provide, to the metal sheet, the shape such that the longitudinal line length gradually increases from the boundary 6 between the top sheet portion 2 and the vertical wall portion 3 toward the boundary 7 between the vertical wall portion 3 and the flange portion 4, i.e., along the widthwise direction, in the intermediate formed product 40. In this case, the longitudinal line length at the position 17 to be the boundary 7 between the vertical wall portion 3 and the flange portion 4 is designed to become longer than the line length of the top sheet portion 2 by the above-mentioned ΔL. In other words, the line length difference between the longitudinal line length at the position 17 to be the boundary 7 between the vertical wall portion 3 and the flange portion 4 and the longitudinal line length at the boundary 7 between the vertical wall portion 3 and the flange portion 4 in the press-formed component shape 1 is set to equal to or less than 10%, and preferably equal to or less than 5%, of the longitudinal line length at the boundary 7 between the vertical wall portion 3 and the flange portion 4 in the press-formed component shape 1.

To provide such a shape that satisfies the two conditions, the present embodiment provides a wavy shape formed by repeated uneven portions such that amplitude is the largest at the flange portion forming position 14 to the regions of the vertical wall portion forming position 13 and the flange portion forming position 14.

Next, a specific example of design of the wavy shape will be described.

The present design is made in such a manner that the required line length ΔL is secured by the wavy shape including a plurality of uneven portions along the longitudinal direction at the position 17 to be the boundary 7 between the vertical wall portion 3 and the flange portion 4.

First, as illustrated in FIG. 5, 2n+1 pieces (n is an integer of 1 or more) of control points 30 are set at equal intervals along the position 17 to be the boundary 7 between the vertical wall portion 3 and the flange portion 4 in the desired press-formed component shape 1. FIG. 5 illustrates and describes only a front-side region, but even a rear-side region is similarly provided with the wavy shape to secure the line length. Additionally, intervals for providing the control points 30 do not necessarily have to be set to equal intervals.

It is also preferable to design such that a length between adjacent control points 30 is equal to or more than 10% of a component length to arrange the plurality of control points 30.

Next, among the plurality of control points 30, the control points 30 at even-numbered positions or odd-numbered positions along the longitudinal direction are displaced in the sheet thickness direction. In other words, every other one of the control points 30 is displaced in the sheet thickness direction of the metal sheet 10. Although this example exemplifies a case where directions of displacement of the control points to be displaced are alternately displaced in opposite directions, the directions of displacement of the control points to be displaced may be all the same. After that, all of the 2n+1 pieces of the control points 30 are smoothly connected by a spline curve to create a line 31. Although the present embodiment exemplifies a case where an amount of displacement of each control point 30 to be displaced is constant, each amount of the displacement may be different. For example, the amount of the displacement may be set to larger as being closer to a center of the curved portion.

Note that, in the flange portion forming position 14, the amplitudes of the uneven portions are set to constant, for example, toward an outer edge, i.e., along the widthwise direction.

Next, a surface shape of the wavy shape is designed by a surface that smoothly connects the line 31 created by the above spline curve and the position 16 to be the boundary 6 between the top sheet portion 2 and the vertical wall portion 3 in the widthwise direction. Note that wave amplitude is zero at the boundary 6 between the top sheet portion 2 and the vertical wall portion 3. As a result, there is provided a wavy shape such that the amplitude of the uneven shapes in the sheet thickness direction increases from the position corresponding to the boundary between the top sheet portion 2 and the vertical wall portion 3 toward the position corresponding to the boundary between the vertical wall portion 3 and the flange portion 4. Herein, the direction from the position corresponding to the boundary between the top sheet portion 2 and the vertical wall portion 3 toward the position corresponding to the boundary between the vertical wall portion 3 and the flange portion 4 may be a widthwise direction of the top sheet portion forming position 12 or a direction inclined in the longitudinal direction by a previously set angle with respect to the widthwise direction. In short, the direction may be any direction that intersects the vertical wall portion forming position 13 in the widthwise direction.

Figure 6A:
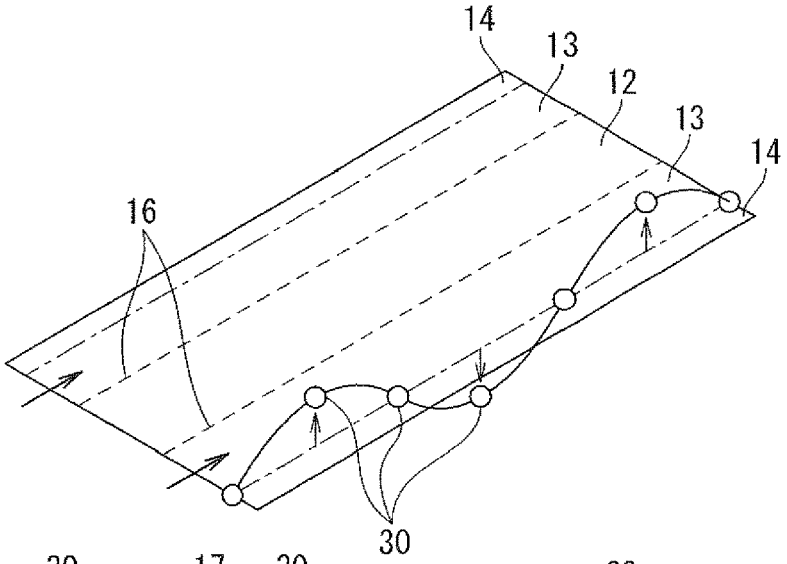
FIG. 6 is a diagram illustrating an example of displacement of the control point and an example of a spline line thereof.
Figure 6B:
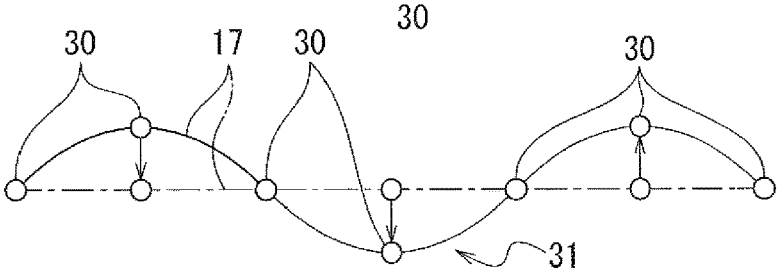
Figure 7A:
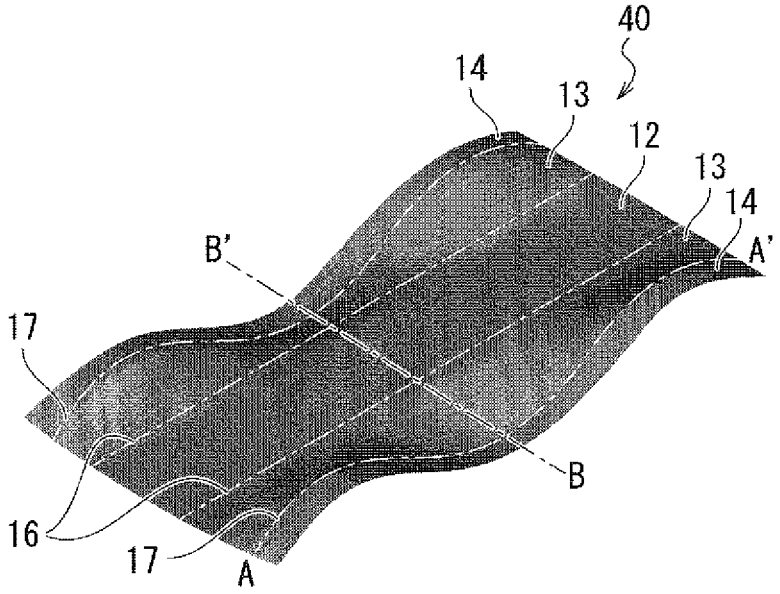
FIG. 7A is a perspective view.
Figure 7B:
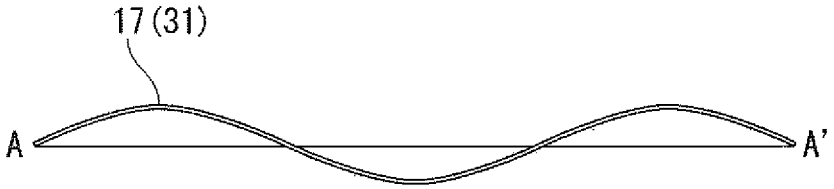
FIG. 7B is a cross-sectional view taken along line A-A' thereof.
Figure 7C:
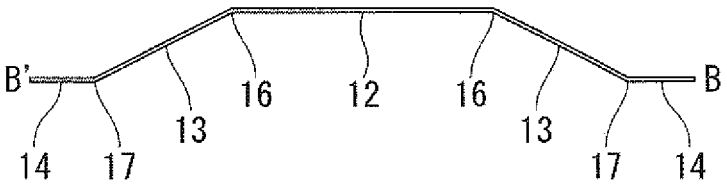
FIG. 7C is a cross-sectional view taken along line B-B' thereof.
Figure 8A:
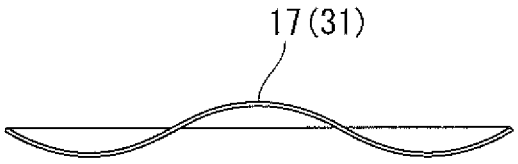
FIG. 8 is a diagram illustrating other examples of uneven shapes.
Figure 8B:
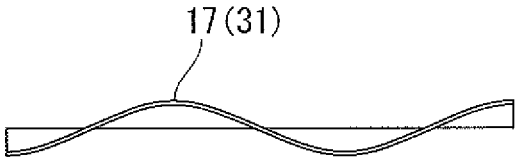
Figure 8C:
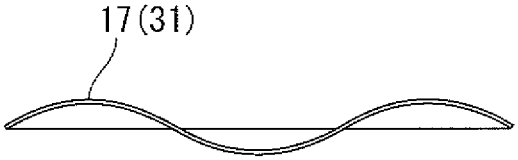
Figure 8D:
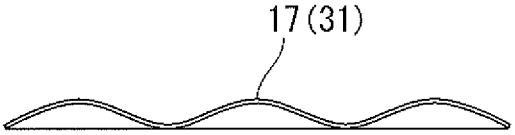
Figure 8E:
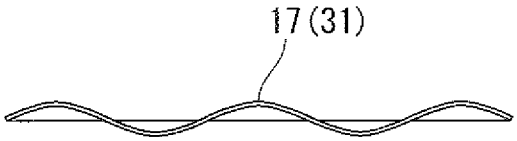

For example, as illustrated in FIG. 6, when creating three uneven shapes (a waveform shape), seven control points 30 are set. While end points of the control points 30 are fixed, every other control point 30 is displaced in the sheet thickness direction by a constant distance to determine the uneven shapes (the waveform shape) at the boundary between the vertical wall portion forming position 13 and the flange portion forming position 14. FIG. 7 illustrates a shape of the intermediate formed product 40 designed under the above conditions.

Additionally, other than the shape illustrated in FIG. 7, as illustrated in FIG. 8, the wavy shape may have a shape such that the directions of the uneven portions are reversed, a shape such that the uneven shapes are shifted by a half cycle, a shape formed by only protruding shapes or recessed shapes, a shape such that the numbers of the uneven portions are changed, or a shape such that amplitudes of the uneven shapes, respectively, are changed. It is sufficient that the wavy shape has a shape that can secure the line length ΔL.

(Die for First Forming Step 9A)

Figure 9:
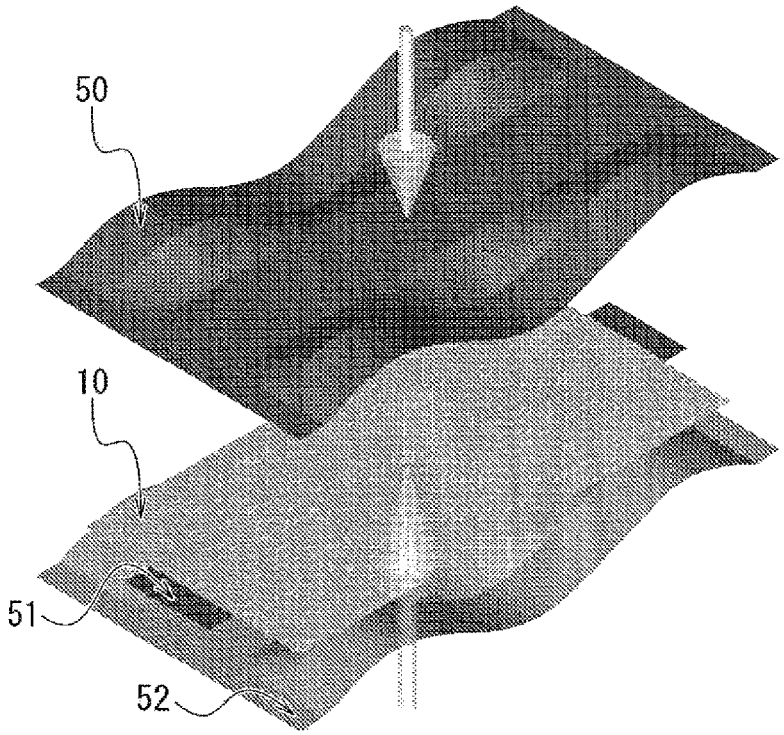
FIG. 9 is a diagram illustrating an example of a die for use in a first forming step.

FIG. 9 illustrates a die for forming the intermediate formed product 40 designed as above.

The die for use in the first forming step 9A is, for example, a die including an upper die formed by a die 50 and a lower die formed by a punch 52 and a blank holder 51 configured to pinch the portion to be the top sheet portion 2 of the desired press-formed component shape 1 together with the die 50.

Then, after pinching the top sheet portion forming position 12 of the flat-shaped metal sheet 10 by the die 50 of the upper die and the blank holder 51 of the lower die, the upper die is further lowered, and the die 50 and the punch 52 stretch form the uneven shapes formed by the wavy shape designed above on the vertical wall portion forming position 13 and the flange portion forming position 14.

<Second Forming Step 9B>

The second forming step 9B is a step of performing bending on the intermediate formed product 40 formed in the first forming step 9A to form the ridge line 6 between the top sheet portion 2 and the vertical wall portion 3 and the ridge line 7 between the vertical wall 3 portion and the flange portion 4 in the desired press-formed component shape 1, thereby forming the intermediate formed product 40 into the desired press-formed component shape 1.

Figure 10:
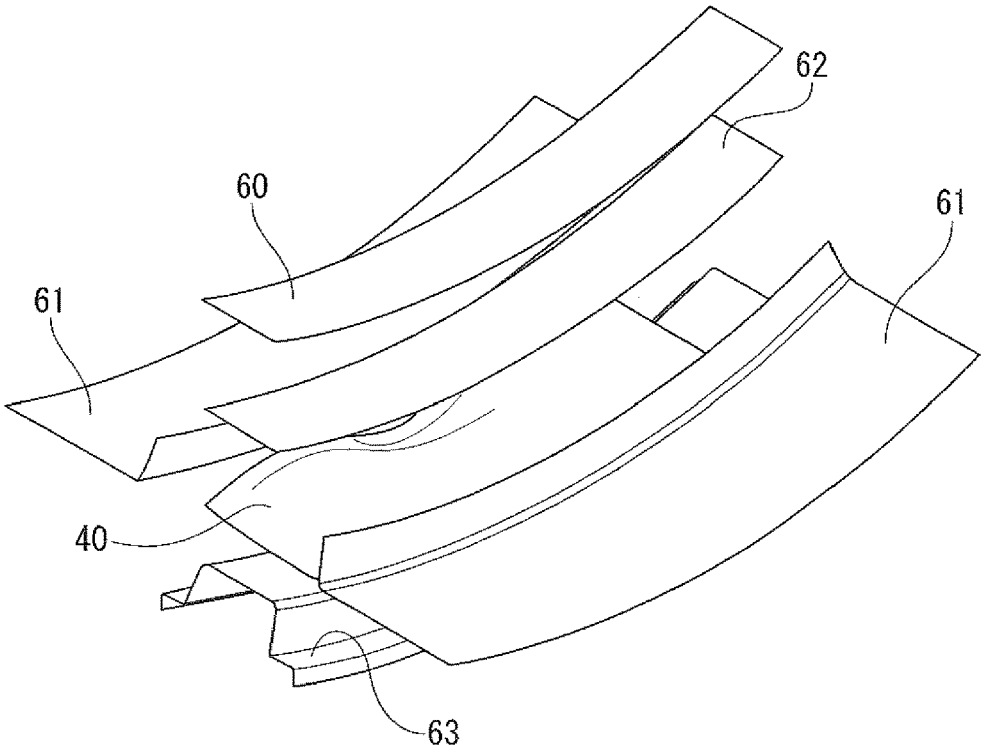
FIG. 10 is a diagram illustrating an example of a die for use in a second forming step.

The second forming step 9B uses a bending die, for example, as illustrated in FIG. 10, that includes an upper die formed by a die 60 and bending blades 61 configured to perform bending at ridge line portion positions, a pad 62 and a lower die formed by a punch 63.

In the bending die, the top sheet portion forming position 12 of the metal sheet 10 is pinched by the punch and the die, and in this state, the bending blades 61 on left and right are moved down to a forming bottom dead center toward the punch to perform bending of the vertical wall portions 3 and the flange portion 4.

Figure 11:
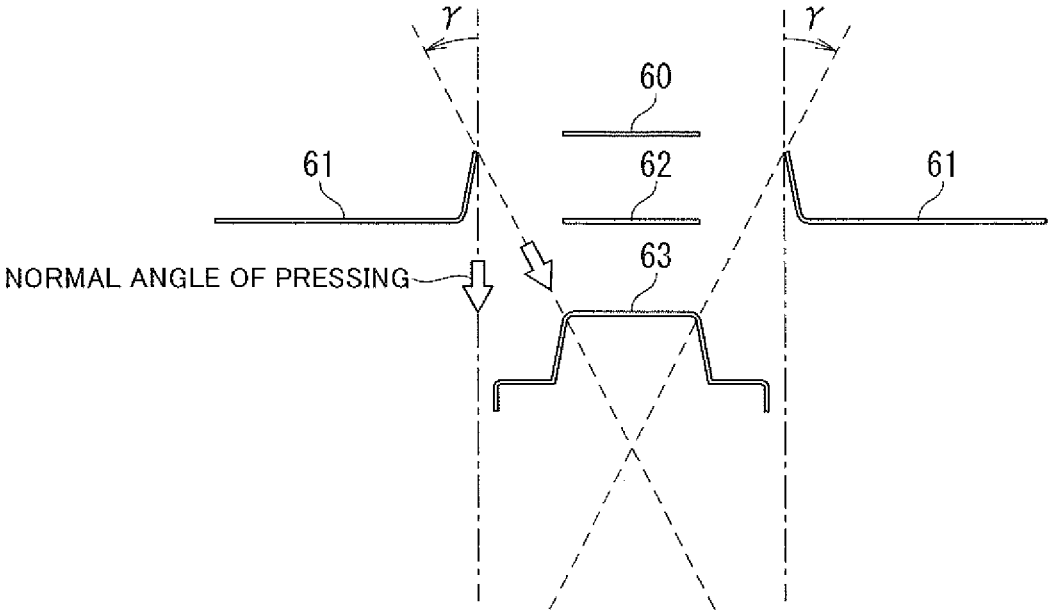
FIG. 11 is a diagram illustrating directions of movement of bending blades during bending.

In this case, as illustrated in FIG. 11, the bending blades 61 are preferably configured to perform the forming by moving at an angle γ ranging from 0 degrees to 90 degrees, preferably an angle γ ranging from 0 degrees to 45 degrees, and more preferably an angle γ ranging from 5 degrees to 40 degrees, with respect to a normal angle of pressing, toward a direction away from the punch 63.

Effects and Others (1) The method for producing a press-formed component of the present embodiment includes: the first forming step 9A of press forming the metal sheet 10 into the intermediate formed product 40 in which, in regions to be the vertical wall portion 3 and the flange portion 4, a wavy shape is formed that includes uneven shapes continuous along a longitudinal direction, an amplitude of the uneven shapes in a sheet thickness direction increasing from the position 16 corresponding to the boundary 6 between the top sheet portion 2 and the vertical wall portion 3 toward the position 17 corresponding to the boundary 7 between the vertical wall portion 3 and the flange portion 4; and the second forming step 9B of performing bending on the intermediate formed product 40 to form the ridge line 6 between the top sheet portion 2 and the vertical wall portion 3 and the ridge line 7 between the vertical wall portion 3 and the flange portion 4 in the press-formed component shape 1. Then, the wavy shape is set such that a line length difference between a longitudinal line length at the position 17 corresponding to the boundary 7 between the vertical wall portion 3 and the flange portion 4 in the intermediate formed product 40 and a longitudinal line length at the boundary 7 between the vertical wall portion 3 and the flange portion 4 in the press-formed component shape 1 is equal to or less than 10% of the longitudinal line length at the boundary 7 between the vertical wall portion 3 and the flange portion 4 in the press-formed component shape 1.

This structure enables a formed component that has a hat-shaped cross-sectional shape including, at least one place, a shape curved in such a manner as to protrude toward a flange portion as seen in a side view to be produced with reduced forming defects such as cracks, wrinkles, and lowered dimensional accuracy. Additionally, according to the aspects of the present invention, for example, a spring-back due to a stress difference in the longitudinal direction between the top sheet portion 2 and the flange portion 4 can be suppressed.

(2) In this case, it is preferable to set the wavy shape in the first forming step 9A such that when a vertical height of the vertical wall portion 3 is defined as H (mm) and an angle formed by the top sheet portion 2 at the curved portion in the press-formed component shape 1 as seen in the side view is defined as α (degree), a longitudinal line length at the position corresponding to the boundary between the vertical wall portion 3 and the flange portion 4 in the intermediate component becomes longer than a longitudinal line length at the position on the metal sheet before forming the intermediate component by ΔL that is defined by the following expression:

$$0.9\times 2\pi H\times(\alpha/360)\leq \Delta L\leq 1.1\times 2\pi H\times(\alpha/360)$$

This structure can further ensure that the press-formed component is produced with reduced forming defects such as cracks, wrinkles, and lowered dimensional accuracy.

(3) In addition, the wavy shape is set such that after setting n pieces (n≥3) of the control points 30 along the longitudinal direction at the position 17 corresponding to the boundary 7 between the vertical wall portion 3 and the flange portion 4 and displacing the control points 30 located at even-numbered positions or odd-numbered positions in the sheet thickness direction, a line that smoothly connects the n pieces of the control points 30 by a spline curve or the like is created into the uneven shapes at the position 17 corresponding to the boundary 7 between the vertical wall portion 3 and the flange portion 4, and then the line 31 connecting by the spline curve or the like and the line 31 corresponding to a boundary line between the top sheet portion 2 and the vertical wall portion 3 are smoothly connected in the widthwise direction into a surface shape.

This structure can facilitate setting of the desired wavy shape.

(4) In the method for producing a press-formed component of the present embodiment, at least one position of the position 16 corresponding to the ridge line 6 between the top sheet portion 2 and the vertical wall portion 3 and the position 17 corresponding to the ridge line 7 between the vertical wall portion 3 and the flange portion 4, at least one bead shape 20, 21 or crease shape extending in a direction along the corresponding ridge line is formed in processing before the second forming step 9B.

This structure improves formability in the second forming step 9B.

(5) The press forming device for use in the second forming step 9B includes the upper die including the bending blades 61 for bending the metal sheet 10 at ridge line portion positions to perform bending of the vertical wall portion 3 and the flange portion 4 and the lower die including the punch 63, in which the bending blades 61 are moved at the angle γ set within the range of from 0 degrees to 90 degrees with respect to a pressing direction to perform the bending.

This structure enables the bending in the second forming step 9B to be performed with high formability.

(6) As the metal sheet 10 for bending, the metal sheet 10 for press forming is employed that includes a wavy shape including uneven shapes continuous along a longitudinal direction in regions to be the vertical wall portion 3 and the flange portion 4, an amplitude of the uneven shapes in a sheet thickness direction increasing from the position corresponding to the boundary between the top sheet portion 2 and the vertical wall portion 3 toward the position corresponding to the boundary between the vertical wall portion 3 and the flange portion 4, in which the wavy shape is set such that a line length difference between a longitudinal line length at the position 17 corresponding to the boundary 7 between the vertical wall portion 3 and the flange portion 4 and a longitudinal line length at the boundary 7 between the vertical wall portion 3 and the flange portion 4 in the press-formed component shape 1 is equal to or less than 10% of the longitudinal line length at the boundary 7 between the vertical wall portion 3 and the flange portion 4 in the press-formed component shape 1.

This structure can improve formability in processing by normal bending.

Examples

Next, Example of the present embodiment will be described.

Assuming a 1180 MPa grade cold-rolled steel sheet (sheet thickness: 1.4 mm), a press forming analysis was performed on a component having the shape as illustrated in FIG. 1. In the present Example, shape parameters for defining the press-formed component shape 1 were set as follows:

<Cross-Sectional Shape Parameters>

Top sheet portion width W: 100 mm

Vertical wall height H: 50 mm

Vertical wall angle θ: 10 degrees

Flange length f: 30 mm

<Bending Parameters in Plan View>

Bending angle α: 30 degrees

Curvature radius R of top sheet portion: 1000 mm

The metal sheet 10 for use in forming was set such that the longitudinal length thereof was equal to the longitudinal length of the top sheet portion 2 in the desired press-formed component shape 1. Specifically, on the basis of the above expression (1), the longitudinal length of the metal sheet 10 was set to 523.6 mm. Additionally, the width thereof was set to about 260 mm.

Next, the length of the flange portion 4 in the desired press-formed component shape 1 was calculated from the above expression (2) and resulted in 549.8 mm.

Accordingly, the intermediate formed product 40 was determined to be designed such that, in the intermediate formed product 40, the longitudinal length at the boundary between the vertical wall portion forming position 13 and the flange portion forming position 14 became longer by ΔL=26.2 mm.

To secure the line length obtained by the above calculation, three uneven shapes such that protruded upward, protruded downward, and protruded upward as seen from the position of the top sheet portion 2, were designed along the longitudinal direction in the regions of the vertical wall portion forming position 13 and the flange portion forming position 14, as illustrated in FIG. 6. Amplitudes of the uneven shapes were unified to 26 mm in all the uneven portions. In this case, the line length at the boundary between the vertical wall portion forming position 13 and the flange portion forming position 14 was about 550 mm, which is substantially equal to the required line length obtained by the above calculation.

Next, a forming analysis of the metal sheet 10 was performed by using the die illustrated in FIG. 9 to obtain the intermediate formed product 40. In the forming analysis, a blank holding force of 50 ton was applied.

Next, in the second forming step 9B, a bending analysis of the intermediate formed product 40 was performed by the bending die illustrated in FIG. 10. In the present forming, the bending blades 61 for bending ridge lines used a cam mechanism for bending at an angle inclined by 30 degrees with respect to a pressing direction to perform the forming. Additionally, in this case, a pad pressure of 5 ton was applied.

Figure 12A:
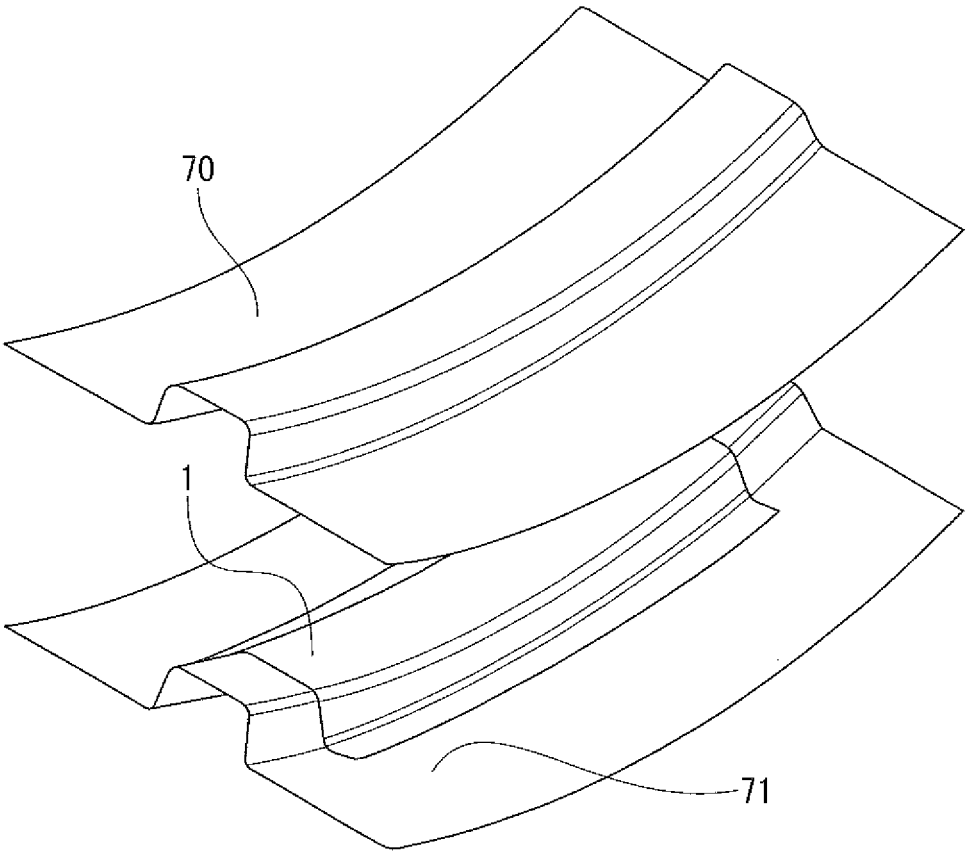
FIG. 12 is a diagram illustrating a die used in a third forming.
Figure 12B:
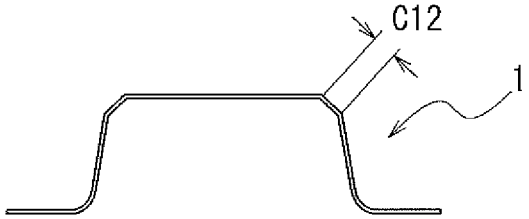

Furthermore, to suppress a spring-back that causes opening of cross section, a forming analysis using a restrike die as illustrated in FIG. 12 was performed as a third forming step after the second forming step 9B. The restrike die includes an upper die formed by a die 70 and a lower die formed by a punch 71, and provides a chamfered shape of about C12 to bending portions adjacent to the top sheet portion 2 to suppress the opening of the cross section.

Figure 13:
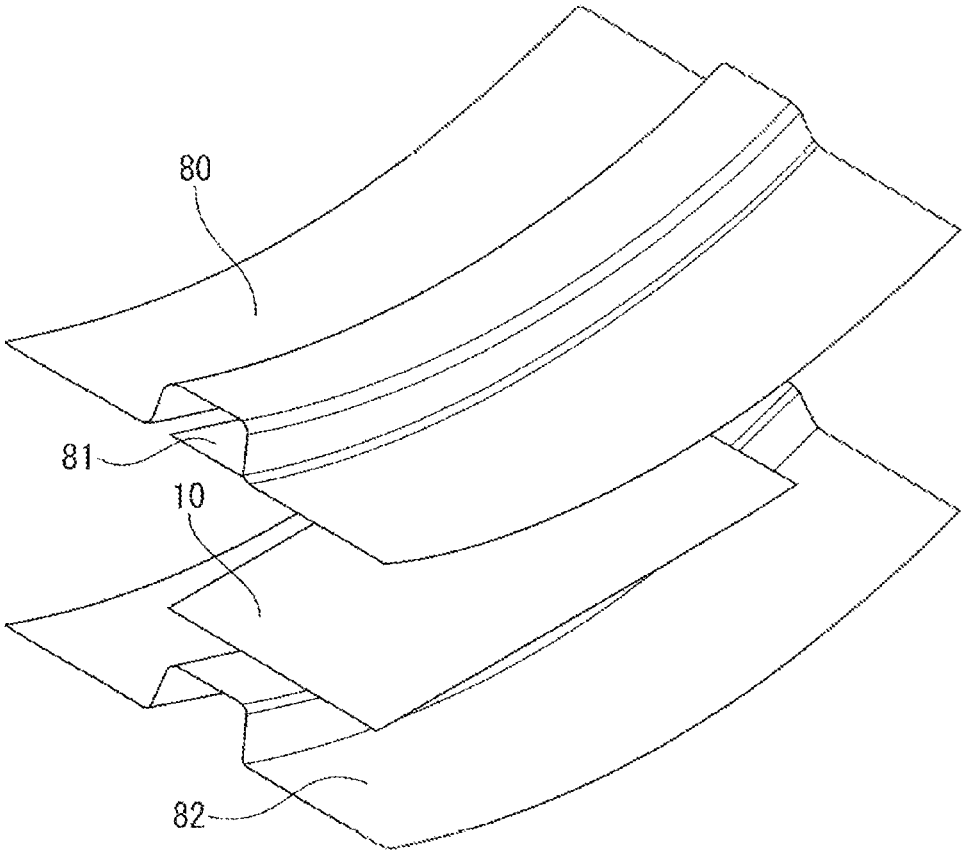
FIG. 13 is a diagram illustrating a die for conventional bending.

In addition, as Comparative Example with respect to the method based on the present invention, a forming analysis using conventional pad bending was also performed together. FIG. 13 illustrates a pad bending die used in this case. The pad bending die includes an upper die formed by a die 80 and a pad 81 and a lower die formed by a punch. It is a forming method that bends ridge lines while lowering the upper die and pinching the top sheet portion forming position 12 by the pad 81 and the punch 82. The pad pressure was 5 ton.

The forming analyses were performed under the above conditions to calculate a formability evaluation distribution at a forming bottom dead center in the conventional pad bending and the method based on the present invention, respectively.

Figure 14:
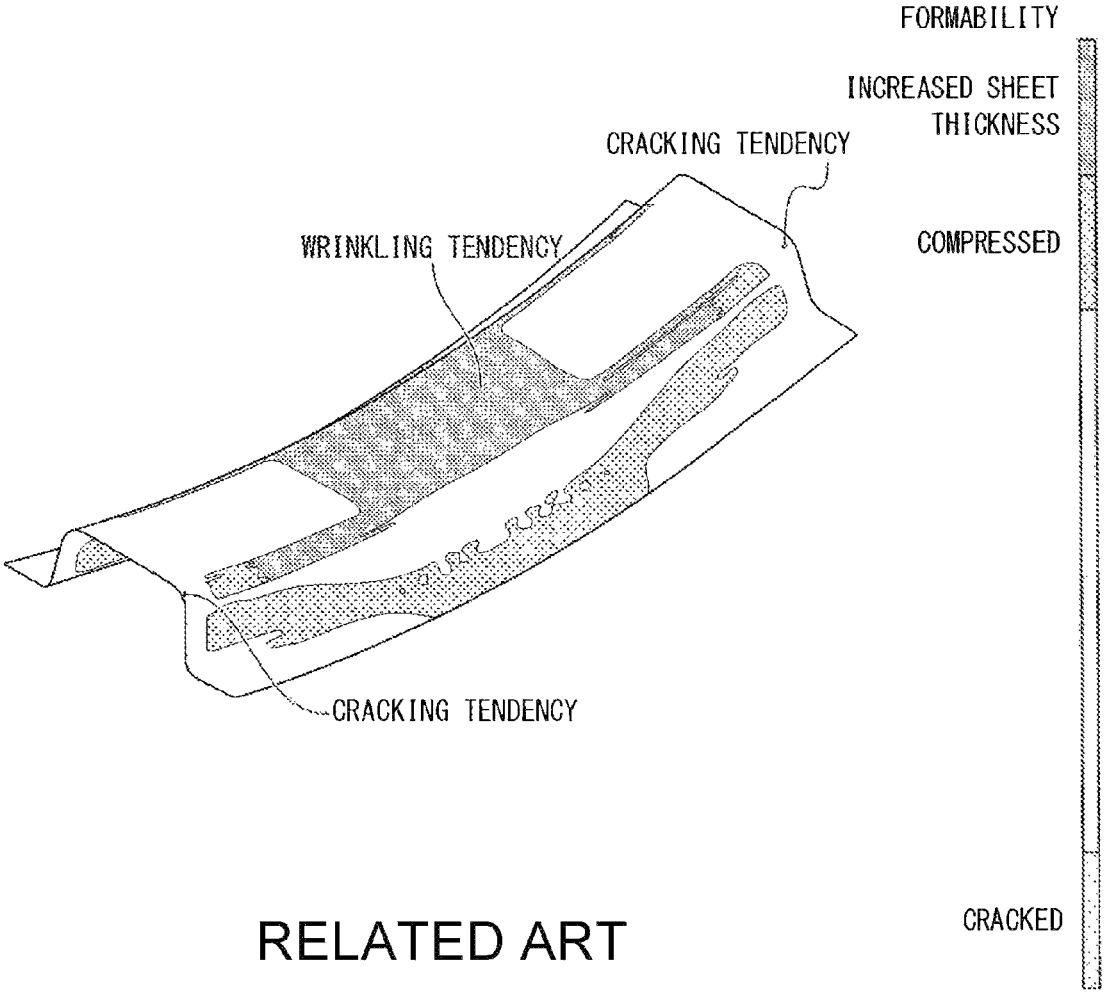
FIG. 14 is a diagram of evaluation on formability in the conventional bending.

According to the formability evaluation distributions, the conventional bending caused material excess on the top sheet portion 2 of the press-formed component shape 1, which was therefore evaluated as causing wrinkling tendency, as illustrated in FIG. 14. Additionally, cracking tendency was also recognized near both ends of bending ridge lines adjacent to the top sheet portion 2.

Figure 15:
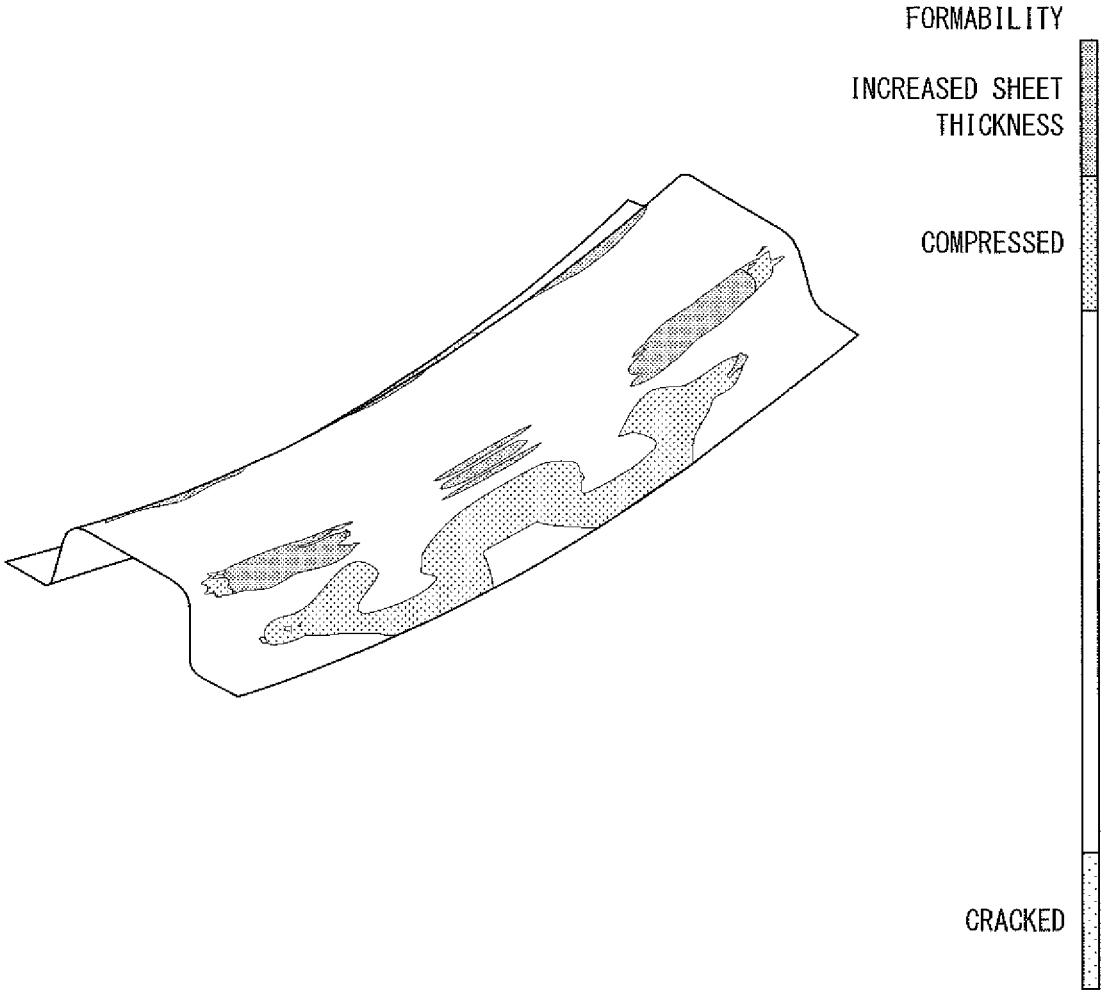
FIG. 15 is a diagram of evaluation on formability in forming based on the present invention.

On the other hand, the method based on the present invention enabled forming without causing any wrinkle tendency on the top sheet portion 2 and any cracking tendency, as illustrated in FIG. 15.

Next, a calculation was performed for a sheet thickness center stress distribution in the longitudinal direction at the forming bottom dead center in the convention pad bending and the method based on the present invention, respectively.

In the convention pad bending, a large compressive stress (−1.134 $E^3$ on a center portion side in the longitudinal direction) was applied to the top sheet portion 2, and conversely, a large tensile stress (1.009 $E^3$ on the center portion side in the longitudinal direction) was applied to the flange portion 4. On the other hand, in the method based on the present invention, compressive stress on the top sheet portion 2 was significantly reduced and resulted in −861.7 on the center portion side in the longitudinal direction. Moreover, tensile stress was hardly generated on the flange portion 4, and resulted in a low value of 455.9 on the center portion side in the longitudinal direction.

Subsequently, a calculation was performed for a distribution of a deviation amount from the desired press-formed component shape 1 after release in the conventional pad bending and the method based on the present invention, respectively.

In the component formed by the conventional pad bending, there was a significant difference in the sheet thickness center stress in the longitudinal direction between the top sheet portion 2 and the flange portion 4, which caused a significant spring-back such that end portions in the longitudinal direction fall. On the other hand, the method based on the present invention significantly reduced sheet thickness center stress difference in the longitudinal direction between the top sheet portion 2 and the flange surface, whereby it was confirmed that a spring-back such that the end portions in the longitudinal direction are lifted was significantly suppressed as compared to the component formed by the conventional pad bending.

Herein, while the Example based on the present invention has been the case where the third forming step is included, it has been confirmed that even without the third forming step, forming can be performed without causing any wrinkle tendency on the top sheet portion 2 and any cracking tendency, and the deviation amount from the desired press-formed component shape 1 after release is also small as compared to forming by the conventional bending.

Herein, this application claims the benefit of priority of Japanese Patent Application No. 2018-034571 (filed on Feb. 28, 2018), the entirety of which is hereby incorporated by reference. Herein, although the above description has been given with reference to the limited number of embodiments, the scope of the present invention is not limited thereto, and modifications of the respective embodiments based on the above disclosure are obvious to those skilled in the art.

REFERENCE SIGNS LIST

1: Press-formed component shape
2: Top sheet portion
3: Vertical wall portion
4: Flange portion
6, 7: Boundary (ridge line)
9A: First forming step
9B: Second forming step
10: Metal sheet
12: Top sheet portion forming position
13: Vertical wall portion forming position
14: Flange portion forming position
20, 21: Bead shape
30: Control point
31: Spline curve
40: Intermediate formed product
62: Pad

The invention claimed is:

1. A method for producing a press-formed component by press forming a metal sheet, the press-formed component having a press-formed component shape that has a cross-sectional shape including a vertical wall portion and a flange portion on each of both sides of a top sheet portion in a widthwise direction and that includes, at one or more places along a longitudinal direction of the top sheet portion, a curved portion curved in a sheet thickness direction in such a manner as to protrude toward the flange portion as seen in a side view, the method comprising:

a first forming step of press forming the metal sheet into an intermediate formed product in which a wavy shape is formed in regions to be the vertical wall portion and the flange portion on each of both sides of the top sheet portion in the widthwise direction; and a second forming step of performing bending on the intermediate formed product to form a ridge line between the top sheet portion and the vertical wall portion and a ridge line between the vertical wall portion and the flange portion in the press-formed component shape, wherein on each of both sides of the top sheet portion in the widthwise direction:

the wavy shape includes uneven shapes arranged along the longitudinal direction, and is shaped such that an amplitude of the uneven shapes in the sheet thickness direction increases across a region extending from a position corresponding to a boundary between the top sheet portion and the vertical wall portion toward a position corresponding to a boundary between the vertical wall portion and the flange portion; and the wavy shape is such that a line length difference between a longitudinal line length at the position corresponding to the boundary between the vertical wall portion and the flange portion in the intermediate formed product and a longitudinal line length at the boundary between the vertical wall portion and the flange portion in the press-formed component shape is equal to or less than 10% of the longitudinal line length at the boundary between the vertical wall portion and the flange portion in the press-formed component shape.

2. The method for producing a press-formed component according to claim 1, wherein, in the first forming step, the wavy shape is formed such that when a vertical height of the vertical wall portion is defined as H (mm) and an angle formed by the top sheet portion at the curved portion in the press-formed component shape as seen in the side view is defined as $\alpha$ (degree), the longitudinal line length at the position corresponding to the boundary between the vertical wall portion and the flange portion in the intermediate formed product is longer than a longitudinal line length at the position on the metal sheet before forming the intermediate formed product by ΔL that is defined by the following formula:

$$0.9\times2\pi H\times(\alpha/360)\leq\Delta L\leq1.1\times2\pi H\times(\alpha/360)$$

3. The method for producing a press-formed component according to claim 1, wherein the first forming step comprises:

setting n pieces (n≥3) of control points in such a manner as to arrange along a longitudinal direction of the position corresponding to the boundary between the vertical wall portion and the flange portion; and displacing the control points located at even-numbered positions or odd-numbered positions among the plurality of control points in the sheet thickness direction, such that a line that smoothly connects the n pieces of control points is created into the uneven shapes at the position corresponding to the boundary between the vertical wall portion and the flange portion, and the smoothly connecting line and a line corresponding to a boundary line between the top sheet portion and the vertical wall portion are smoothly connected in the widthwise direction into a surface shape of the intermediate formed product.

4. The method for producing a press-formed component according to claim 1, further comprising, before the second forming step:

forming a bead shape or a crease shape extending along at least one of (i) a position corresponding to the ridge line between the top sheet portion and the vertical wall portion and (ii) a position corresponding to the ridge line between the vertical wall portion and the flange portion.

5. The method for producing a press-formed component according to claim 1, wherein the metal sheet to be press formed is a steel material having a tensile strength of 590 MPa or more.

6. A press forming device used in the second forming step of the method for producing a press-formed component according to claim 1, the press forming device comprising:

an upper die including bending blades for bending the metal sheet at ridge line portion positions to perform bending of the vertical wall portion and the flange portion; and a lower die including a punch, wherein the bending blades are configured to move at an angle within a range of from 0 degrees to 90 degrees with respect to a pressing direction to perform the bending.

7. The method for producing a press-formed component according to claim 2, wherein the first forming step comprises:

setting n pieces (n≥3) of control points in such a manner as to arrange along a longitudinal direction of the position corresponding to the boundary between the vertical wall portion and the flange portion; and displacing the control points located at even-numbered positions or odd-numbered positions among the plurality of control points in the sheet thickness direction, such that a line that smoothly connects the n pieces of control points is created into the uneven shapes at the position corresponding to the boundary between the vertical wall portion and the flange portion, and the smoothly connecting line and a line corresponding to a boundary line between the top sheet portion and the vertical wall portion are smoothly connected in the widthwise direction into a surface shape of the intermediate formed product.

8. The method for producing a press-formed component according to claim 2, further comprising, before the second forming step:

forming a bead shape or a crease shape extending along at least one of (i) a position corresponding to the ridge line between the top sheet portion and the vertical wall portion and (ii) a position corresponding to the ridge line between the vertical wall portion and the flange portion.

9. The method for producing a press-formed component according to claim 3, further comprising, before the second forming step:

forming a bead shape or a crease shape extending along at least one of (i) a position corresponding to the ridge line between the top sheet portion and the vertical wall portion and (ii) a position corresponding to the ridge line between the vertical wall portion and the flange portion.

10. The method for producing a press-formed component according to claim 2, wherein the metal sheet to be press formed is a steel material having a tensile strength of 590 MPa or more.

11. The method for producing a press-formed component according to claim 3, wherein the metal sheet to be press formed is a steel material having a tensile strength of 590 MPa or more.

12. The method for producing a press-formed component according to claim 4, wherein the metal sheet to be press formed is a steel material having a tensile strength of 590 MPa or more.

13. A press forming device used in the second forming step of the method for producing a press-formed component according to claim 2, the press forming device comprising:

an upper die including bending blades for bending the metal sheet at ridge line portion positions to perform bending of the vertical wall portion and the flange portion; and a lower die including a punch, wherein the bending blades are configured to move at an angle within a range of from 0 degrees to 90 degrees with respect to a pressing direction to perform the bending.

14. A press forming device used in the second forming step of the method for producing a press-formed component according to claim 3, the press forming device comprising:

an upper die including bending blades for bending the metal sheet at ridge line portion positions to perform bending of the vertical wall portion and the flange portion; and a lower die including a punch, wherein the bending blades are configured to move at an angle within a range of from 0 degrees to 90 degrees with respect to a pressing direction to perform the bending.

15. A press forming device used in the second forming step of the method for producing a press-formed component according to claim 4, the press forming device comprising:

an upper die including bending blades for bending the metal sheet at ridge line portion positions to perform bending of the vertical wall portion and the flange portion; and a lower die including a punch, wherein the bending blades are configured to move at an angle within a range of from 0 degrees to 90 degrees with respect to a pressing direction to perform the bending.

16. A press forming device used in the second forming step of the method for producing a press-formed component according to claim 5, the press forming device comprising:

an upper die including bending blades for bending the metal sheet at ridge line portion positions to perform bending of the vertical wall portion and the flange portion; and a lower die including a punch, wherein the bending blades are configured to move at an angle within a range of from 0 degrees to 90 degrees with respect to a pressing direction to perform the bending.

17. The method for producing a press-formed component according to claim 9, further comprising, before the second forming step:

forming a bead shape or a crease shape extending along at least one of (i) a position corresponding to the ridge line between the top sheet portion and the vertical wall portion and (ii) a position corresponding to the ridge line between the vertical wall portion and the flange portion.

18. The method for producing a press-formed component according to claim 9, wherein the metal sheet to be press formed is a steel material having a tensile strength of 590 MPa or more.

* * * * *